US008929233B2

(12) United States Patent
Hamaguchi

(10) Patent No.: US 8,929,233 B2
(45) Date of Patent: Jan. 6, 2015

(54) DIGITAL BROADCAST RECEIVING APPARATUS AND DIGITAL BROADCAST RECEIVING METHOD

(75) Inventor: Tomoya Hamaguchi, Iwaki (JP)

(73) Assignee: Alpine Electronics, Inc., Tokyo (JP)

( * ) Notice: Subject to any disclaimer, the term of this patent is extended or adjusted under 35 U.S.C. 154(b) by 584 days.

(21) Appl. No.: 13/296,452

(22) Filed: Nov. 15, 2011

(65) Prior Publication Data

US 2012/0207245 A1 Aug. 16, 2012

(30) Foreign Application Priority Data

Feb. 16, 2011 (JP) ..... 2011-030762

(51) Int. Cl.
*H04H 20/16* (2008.01)
*H04H 60/25* (2008.01)

(52) U.S. Cl.
CPC ..... *H04H 20/16* (2013.01); *H04H 60/25* (2013.01); *H04H 2201/60* (2013.01)
USPC ..... 370/252; 375/316; 375/224; 375/340; 455/3.06; 455/181.1; 455/186.1; 455/426.1; 455/458

(58) Field of Classification Search
USPC ..... 375/316, 224, 340; 455/3.06, 181.1, 455/186.1, 426.1, 458
See application file for complete search history.

(56) References Cited

U.S. PATENT DOCUMENTS 6,452,644 B1 * 9/2002 Shimakawa et al. ..... 348/730
6,782,553 B1 * 8/2004 Ogawa et al. ..... 725/146
7,079,807 B1 * 7/2006 Daum et al. ..... 455/3.06
8,107,559 B2 * 1/2012 Nakata ..... 375/316
2002/0048223 A1 * 4/2002 Ota et al. ..... 369/1
2009/0061763 A1 * 3/2009 Dillon et al. ..... 455/3.05
2009/0131003 A1 * 5/2009 Masamoto et al. ..... 455/186.1
2010/0130122 A1 * 5/2010 Sridhar et al. ..... 455/3.01
2011/0122934 A1 * 5/2011 Nakata ..... 375/224
2013/0016766 A1 * 1/2013 Soma ..... 375/224

FOREIGN PATENT DOCUMENTS

EP 1536580 A2 6/2005
JP 2005-159868 6/2005
JP 2008-109572 5/2007
WO WO 2010004676 A1 * 1/2010

OTHER PUBLICATIONS

Machine Translation of WO/2010/004676.*

* cited by examiner

*Primary Examiner* — Nicholas Jensen
*Assistant Examiner* — Berhanu Belete
(74) *Attorney, Agent, or Firm* — Brinks Gilson & Lione

(57) ABSTRACT

A digital broadcast receiving apparatus includes a receiving unit configured to receive a digital broadcast signal in which predetermined data is transmitted repeatedly. A transmission time estimating unit estimates a transmission time for transmitting data per transmission unit, by analyzing separation information contained in the digital broadcast signal where the separation information describes a time for the transmission unit of data corresponding to the predetermined data. A determining unit determines whether content of the predetermined data has been updated for each data reception starting time after the transmission time has been estimated. If the content has not been updated, the control unit inhibits reception processing by the receiving unit for a predetermined period of time based on the estimated transmission time, and if the content has been updated, the control unit permits the reception processing by the receiving unit.

13 Claims, 5 Drawing Sheets

DIGITAL BROADCAST RECEIVING APPARATUS AND DIGITAL BROADCAST RECEIVING METHOD

PRIORITY CLAIM

This application claims the benefit of Japanese Patent Application No. 2011-030762, filed on Feb. 16, 2011, and which is incorporated by reference herein in its entirety.

BACKGROUND

1. Field of the Invention

The present invention relates to digital broadcast receiving apparatuses and digital broadcast receiving methods and may be suitable for application to a digital broadcast receiving apparatus which receives HD (Hybrid Digital) radio using the "In Band On Channel" (IBOC) terrestrial digital radio broadcasting format, for example.

2. Description of the Related Art

In recent years, the practical use of HD radio in the IBOC terrestrial digital radio broadcasting format has increased in the United States of America. An HD radio receiver supporting HD radio is capable of receiving a simple data broadcast signal, such as traffic information and weather forecast simultaneously with a digital audio broadcast signal. More specifically, an HD radio receiver has two tuners, and the tuners are assigned for receiving a digital audio broadcast signal and for receiving a data broadcast signal, respectively.

In HD radio, the content of data sets transmitted repeatedly and continuously by data broadcast signals, is updated about every 15 minutes, and the data sets having the same content are repeatedly transmitted until updated. For example, as illustrated in FIG. 5, data broadcast signals are transmitted in order of a data set (A1) and a data set (A2). Until the data set (A1) is updated to the data set (A2), a data set (A1') and a data set (A1") having the same content are repeatedly and sequentially transmitted.

Nevertheless, in an HD radio receiver in the past, the time for permitting data reception processing (reception time) and the time for inhibiting data reception processing (reception holding time) are fixedly defined, and the reception time and the reception holding time are alternately switched. This causes unnecessary reception processing in which the repeatedly transmitted data sets (A1', A1") having the same content are received during a period when the content of the data set (A1) has not been updated as illustrated in FIG. 5. During the transmission of the data set (A2) updated from the data set (A1), the reception holding time may start. In this case, the updated data set (A2) may not be completely received and may be dropped.

On the other hand, RDS (Radio Data System) broadcast which is practically used mainly in European countries, GAP data describing the transmission intervals of road traffic information is transmitted. This allows switching between road traffic information reception processing and other processing on the basis of the transmission intervals described by the GAP data. For example, there has been proposed a technology that changes the operating period of reception status check on an alternative frequency which is to be performed as the other processing on the basis of the GAP data. (Refer to Japanese Unexamined Patent Application Publication No. 2005-159868).

The road traffic information is transmitted from a road traffic information center through a roadside beacon. It is known that the road traffic information transmitted from the center is updated substantially periodically (about every five minutes). A technology has been proposed which supplies and terminates the power supply to receiving means for receiving the road traffic information in accordance with the update period to prevent unnecessary power consumption during a period when the road traffic information has not been updated. (Refer to Japanese Unexamined Patent Application Publication No. 2008-109572).

However, in HD radio, the number of times of repeated transmission of data sets having the same content is different in accordance with the amount of data to be transmitted in reality. In addition, in HD radio, information describing the number of times of repetition and/or the next timing for updating the content are not transmitted at all. The timing when the content of data sets to be transmitted is updated is not available to HD radio receivers. Thus, the technologies described in Japanese Unexamined Patent Application Publication Nos. 2005-159868 and 2008-109572 may not applicable to HD radio due to the above deficiencies.

SUMMARY

The present invention was made in order to solve those problems. It is an object of the present invention to prevent unnecessary reception processing in which repeatedly transmitted data sets having the same content are received during a period when the content of data sets has not been updated and to prevent dropping of updated data in reception of digital broadcast without information describing data transmission intervals.

In order to achieve the object, according to one embodiment of the present invention, when digital broadcast signals are received in which data describing predetermined information are continuously transmitted, a transmission time for transmitting data per transmission unit is estimated by using separation information contained in the digital broadcast signal and indicating separation of the transmission unit of the data. After that, whether the content of the predetermined information has been updated or not is determined every data reception starting time. If it is determined that the content has not been updated, data reception processing is inhibited for a predetermined period of time based on the estimated transmission time while, if it is determined that the content has been updated, the data reception processing is permitted.

According to one embodiment of the present invention configured as described above, the transmission time for transmitting data per transmission unit is estimated. When each data set is received after that and if it is determined that the content of predetermined information has not been updated (or data sets having the same content is repeatedly transmitted), the data reception processing is inhibited for a predetermined period of time based on the transmission time. This may prevent unnecessary reception processing in which the repeatedly transmitted data sets having the same content are received during a period when the content of data sets has not been updated in reception of digital broadcast without information describing data transmission intervals. If it is determined that the content of the predetermined information has been updated, the data reception processing is permitted until the next data set is received. This may prevent the inhibition of data reception processing while the updated data set is being transmitted and may securely prevent the dropping of the updated data.

DETAILED DESCRIPTION

Figure 1:
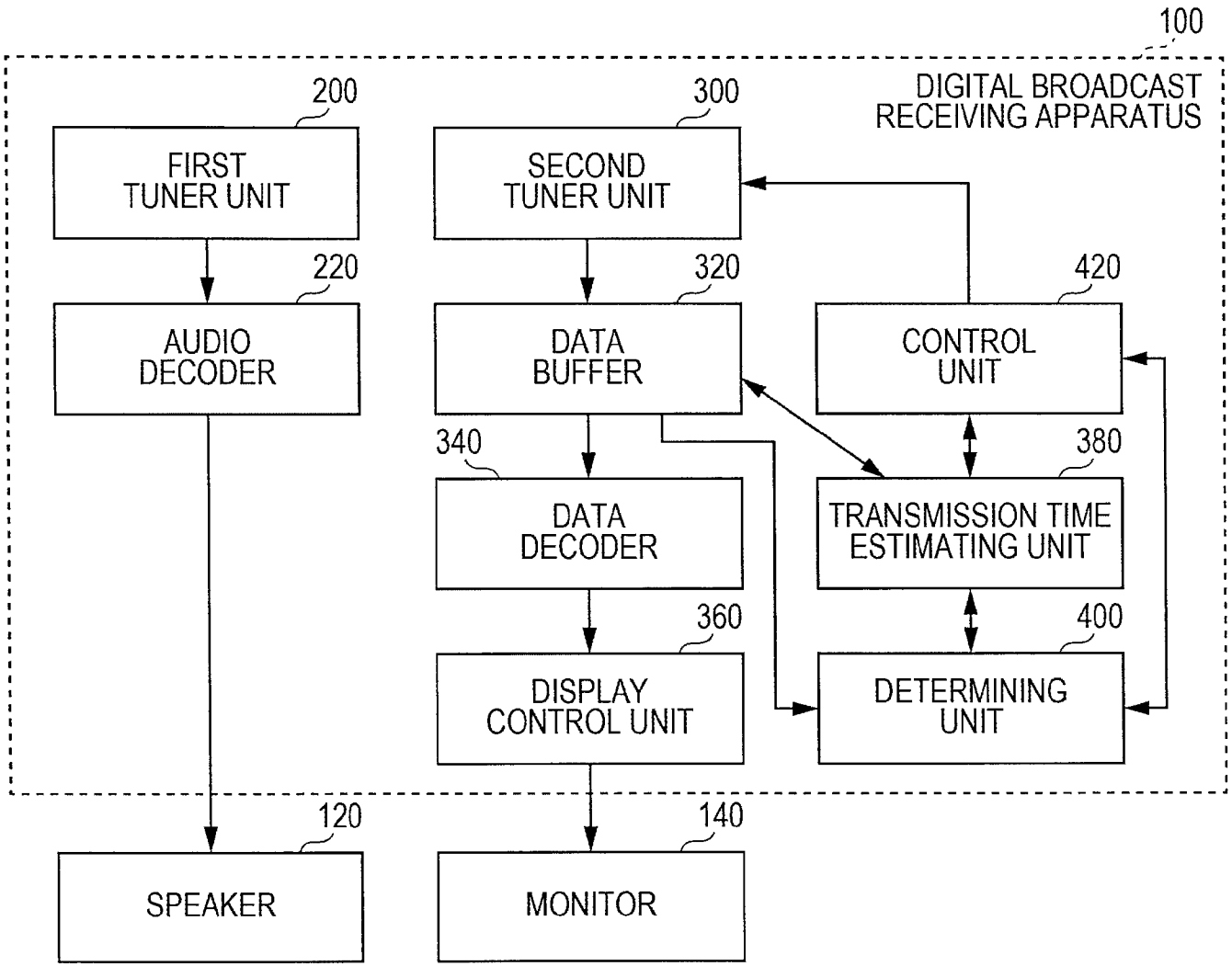
FIG. 1 is a block diagram of a digital broadcast receiving apparatus according to a first embodiment.

A first embodiment of the present invention will be described below with reference to drawings. FIG. 1 is a block diagram illustrating an entire configuration example of a digital broadcast receiving apparatus 100 according to a first embodiment. The digital broadcast receiving apparatus 100 supports HD radio that is IBOC terrestrial digital radio broadcasting and may receive digital audio broadcast and simple data broadcast simultaneously through two tuner units.

As illustrated in FIG. 1, the digital broadcast receiving apparatus 100 includes a first tuner unit 200, an audio decoder 220, a second tuner unit 300, a data buffer 320, a data decoder 340, a display control unit 360, a transmission time estimating unit 380, a determining unit 400 and a control unit 420. The second tuner unit 300 corresponds to a receiving unit of one embodiment of the present invention.

The first tuner unit 200 receives a digital audio broadcast signal transmitted from a broadcasting station (not illustrated, the same is true hereinafter) and performs demodulation processing. Through the demodulation processing, the first tuner unit 200 extracts an audio packet from a digital audio broadcast signal and outputs the extracted audio packet to the audio decoder 220. The audio decoder 220 decodes the audio packet output from the first tuner unit 200 and outputs the audio data acquired by the decoding to the speaker 120.

The second tuner unit 300, under the control of the control unit 420, receives a data broadcast signal (corresponding to a digital broadcast signal of one embodiment of the present invention) transmitted from a broadcasting station and performs demodulation processing. According to this embodiment, the data transmitted continuously by a data broadcast signal may be traffic data describing traffic information such as congestion information (corresponding to data describing predetermined information of the present invention).

The content of the traffic data is updated every predetermined period of time (such as about 15 minutes). The traffic data set having the same content are repeatedly transmitted until the content is updated. However, the number of times of repeated transmission of traffic data set having the same content is different in accordance with the amount of traffic data to be transmitted. The traffic data set includes a plurality of data packets (corresponding to a packet). The last data packet (corresponding to a separation packet, called a "separation packet" hereinafter) of the plurality of data packets included in the traffic data set contains separation information indicating that it is the last data packet. Each of the data packets included in the traffic data contains version information indicating the version of the traffic information included in the traffic data and size information indicating the size of the data packet.

The second tuner unit 300 extracts a data packet from a data broadcast signal by demodulation processing and outputs the extracted data packet to the data buffer 320 which temporarily saves a data packet. The data decoder 340 decodes a data packet saved in the data buffer 320 and outputs the traffic data set acquired by the decoding to the display control unit 360. The display control unit 360 outputs the traffic information to a monitor 140 on the basis of the traffic data set output from the data decoder 340.

The transmission time estimating unit 380 checks whether the separation information is included in the data packets output from the data buffer 320 to the second tuner unit 300 to determine whether the separation packet identified by the corresponding separation information has been received by the second tuner unit 300 or not.

If the power supply to the digital broadcast receiving apparatus 100 is started in response to a user operation on an operating unit (not illustrated), the transmission time estimating unit 380 estimates the time from the determination that one separation packet has been received to the determination that the next separation packet has been received as a transmission time for transmitting traffic data per transmission unit. More specifically, the transmission time estimating unit 380 refers to the size information contained in the data packets (saved in the data buffer 320) received in the period from the reception of one separation packet to the reception of the next separation packet and estimates the value resulting from the division of the total size which is the sum of the sizes of the data packets by the transmission rate of the data broadcast signal as the transmission time in the second tuner unit 300. The transmission time estimating unit 380 holds transmission rate information describing the transmission rate of the data broadcast signal in an internal memory (not illustrated) and grasps the transmission rate with reference to the transmission rate information. The transmission time estimating unit 380 outputs the transmission time information describing the estimated transmission time to the control unit 420.

After the transmission time estimating unit 380 estimates the transmission time, the determining unit 400 determines whether the content of traffic information included in the traffic data has been updated or not every time the traffic data reception is started by the second tuner unit 300. More specifically, the determining unit 400 fetches the separation packet received last by the second tuner unit 300 (the last data packet of one traffic data set) and the next data packet (the first data packet of the next traffic data set) from the data buffer 320. The determining unit 400 refers to the version information contained in the fetched data packets and determines whether the versions are different or not. If determining that the versions are different, the determining unit 400 determines that the content of the traffic information has been updated and notifies the determination result to the transmission time estimating unit 380 and control unit 420. On the other hand, if determining that the versions are not different (or are the same), the determining unit 400 determines that the content of the traffic information has not been updated and notifies the determination result to the control unit 420.

If the control unit 420 receives the notification that the content of the traffic information has not been updated from the determining unit 400, the control unit 420 controls the second tuner unit 300 so as to hold the reception for a predetermined period of time based on the transmission time described by the transmission time information output from the transmission time estimating unit 380 and thus inhibit the reception processing on data broadcast signal by the second tuner unit 300. The predetermined period here refers to a period before the second tuner unit 300 receives the next separation packet and is equal to the period until the time resulting from the subtraction of a predetermined margin (such as five seconds) from the transmission time elapses from the present time. After a lapse of the predetermined period of time, the control unit 420 notifies the fact to the determining unit 400.

If the determining unit 400 receives the notification that the predetermined period of time has elapsed from the control unit 420, the determining unit 400 fetches the separation packet received first from the second tuner unit 300 after that (the last data packet of one traffic data set) and the next data packet (first data packet of the next traffic data set) from the data buffer 320. The determining unit 400 then determines again whether the content of the traffic information has been updated or not.

In the period excluding the predetermined period of time, the control unit 420 controls so as to permit the reception processing on data broadcast signal by the second tuner unit 300. In other words, if the control unit 420 receives the notification that the content of the traffic information has been updated from the determining unit 400, the control unit 420 controls so as to permit the reception processing on data broadcast signals by the second tuner unit 300 until the second tuner unit 300 receives the first data packet contained in the next traffic data set (until the update on the traffic information is determined again).

If the transmission time estimating unit 380 receives the notification that the content of the traffic information has been updated from the determining unit 400, the transmission time estimating unit 380 uses the separation information contained in a data broadcast signal received by the second tuner unit 300 in the period that the control unit 420 permits the reception processing on data broadcast signals to re-estimate the transmission time. More specifically, the transmission time estimating unit 380 re-estimates as the transmission time the period from the determination that one separation packet has been received immediately before the period when the control unit 420 permits the reception processing to the determination that the next separation packet has been received within the permitted period. The transmission time estimating unit 380 outputs the transmission time information describing the re-estimated transmission time to the control unit 420.

Figure 2:
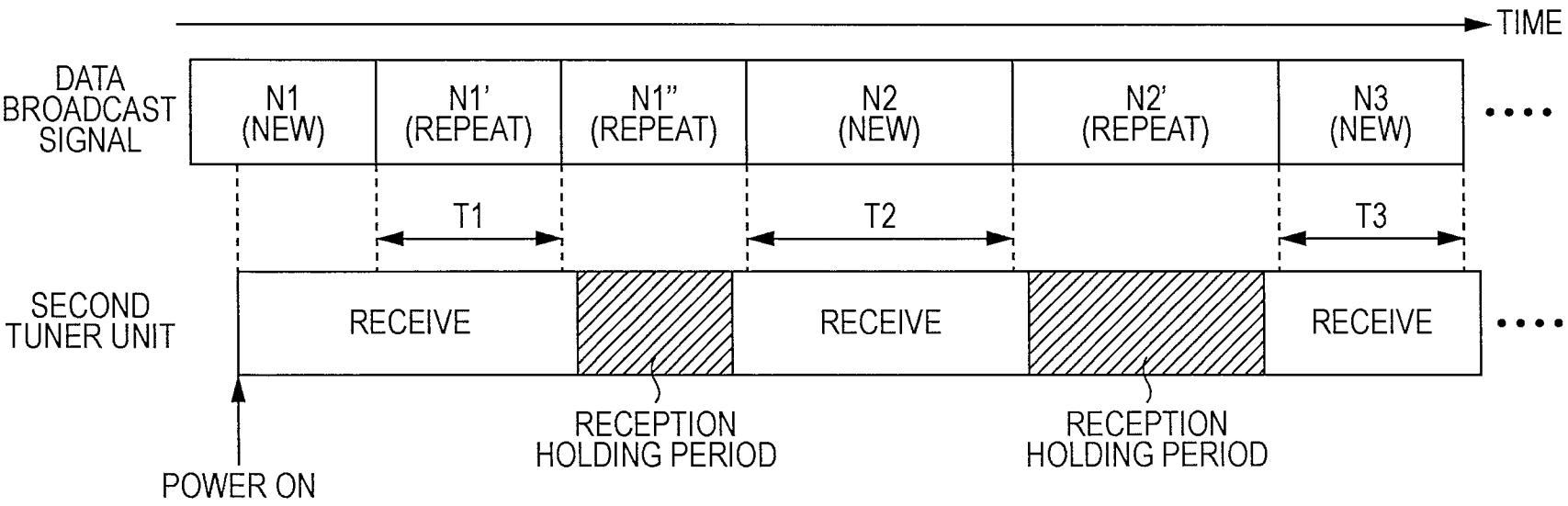
FIG. 2 illustrates a reception operation example on data broadcast signals by the digital broadcast receiving apparatus of the first embodiment.

Next, a reception operation example on data broadcast signals by the digital broadcast receiving apparatus 100 will be described with reference to FIG. 2. As illustrated in FIG. 2, data broadcast signals are transmitted from a broadcasting station in order of a traffic data set (N1), a traffic data set (N2), and a traffic data set (N3). In the period before the traffic data set (N1) is updated to the traffic data set (N2), a traffic data set (N1') and a traffic data set (N1") having the same content are repeatedly transmitted. In the period before the traffic data set (N2) is updated to the traffic data set (N3), the traffic data set (N2') having the same content is repeatedly transmitted. It is assumed that the power supply to the digital broadcast receiving apparatus 100 is started in response to a user operation on an operating unit (not illustrated) while the traffic data set (N1) is being transmitted from a broadcasting station.

When the power supply to the digital broadcast receiving apparatus 100 is started, the second tuner unit 300 first starts the reception processing on data broadcast signals. After that, the transmission time estimating unit 380 checks whether the data packets output from the second tuner unit 300 to the data buffer 320 contain separation information or not to determine the separation packet (the last data packet of the traffic data set (N1)) identified by the separation information has been received by the second tuner unit 300.

The second tuner unit 300 then continues the reception processing on data broadcast signals. The transmission time estimating unit 380 checks whether the data packets output from the second tuner unit 300 to the data buffer 320 contain the separation information or not to determine that the separation packet (the last data packet of the traffic data set (N1')) identified by the separation information has been received by the second tuner unit 300.

In this case, the transmission time estimating unit 380 estimates the period from the determination that the separation packet of the traffic data set (N1) has been received to the determination that the separation packet of the traffic data set (N1') has been received as a transmission time T1 for transmitting traffic data per transmission unit. The transmission time estimating unit 380 then outputs the transmission time information describing the estimated transmission time T1 to the control unit 420.

Next, the determining unit 400 fetches the separation packet of the traffic data set (N1') and the next data packet (the first data packet of the traffic data set (N1")) from the data buffer 320. The determining unit 400 refers to the separation packet and the version information contained in the next data packet fetched from the data buffer 320 and determines whether the versions are different or not to determine whether the content of the traffic information has been updated or not. In the example in FIG. 2, the determining unit 400 determines that the content of the traffic information has not been updated (or the traffic data sets having the same content is repeatedly transmitted) and notifies the determination result to the control unit 420.

Next, the control unit 420 receives the notification that the content of the traffic information has not been updated from the determining unit 400 and controls the second tuner unit 300 so as to hold reception to inhibit the reception processing on the traffic data set (N1") by the second tuner unit 300 for a predetermined period of time based on the transmission time estimated by the transmission time estimating unit 380 (the period before the second tuner unit 300 receives the separation packet of the traffic data set (N1")). After a lapse of the predetermined period of time, the control unit 420 notifies the fact to the determining unit 400.

After receiving the notification of the lapse of the predetermined period of time from the control unit 420, the determining unit 400 fetches the separation packet received first by the second tuner unit 300 (the last data packet of the traffic data set (N1")) and the next data packet (the first data packet of the traffic data set (N2)) from the data buffer 320.

The determining unit 400 refers to the version information contained in the separation packet and the next data packet fetched from the data buffer 320 and determines whether the versions are different or not to determine whether the content of the traffic information has been updated or not. In the example in FIG. 2, the determining unit 400 determines that the content of the traffic information has been updated from the traffic data set (N1) to the traffic data set (N2) and notifies the determination result to the transmission time estimating unit 380 and control unit 420.

The control unit 420 receives the notification that the content of the traffic information has been updated from the determining unit 400 and controls so as to permit the reception processing on data broadcast signals by the second tuner unit 300 for the period until the first data packet of the next traffic data set (N2') of the second tuner unit 300. The transmission time estimating unit 380 receives the notification that the content of the traffic information has been updated from the determining unit 400 and re-estimates the period from the determination that the separation packet of the traffic data set (N1") has been received to the determination that the separation packet of the next traffic data set (N2) has been received as a transmission time T2 for transmitting traffic data per transmission unit. The transmission time estimating unit 380 outputs again the transmission time information describing the re-estimated transmission time T2 to the control unit 420.

Next, the determining unit 400 fetches the separation packet (the last data packet of the traffic data set (N2)) and the next data packet (the first data packet of the traffic data set (N2')) received from the second tuner unit 300 from the data buffer 320. The determining unit 400 then refers to the version information contained in the separation packet and the next data packet fetched from the data buffer 320 and determines whether the versions are different or not to determine whether the content of the traffic information has been updated or not. In the example in FIG. 2, the determining unit 400 determines that the content of the traffic information has not been updated (or traffic data sets having the same content is repeatedly transmit) and notifies the determination result to the control unit 420.

Next, the control unit 420 controls the second tuner unit 300 so as to hold reception for a predetermined period based on the transmission time T2 estimated by the transmission time estimating unit 380 (the period until the separation packet of the traffic data set (N2') is received by the second tuner unit 300) to inhibit the reception processing on the traffic data set (N2') by the second tuner unit 300. The control unit 420 notifies the fact to the determining unit 400 after a lapse of the predetermined period of time.

Next, after receiving the notification of the lapse of the predetermined period of time from the control unit 420, the determining unit 400 fetches the separation packet received first by the second tuner unit 300 (the last data packet of the traffic data set (N2')) and the next data packet (the first data packet of the traffic data set (N3)) from the data buffer 320. The determining unit 400 refers to the version information contained in the separation packet and the next data packet fetched from the data buffer 320 and determines whether the versions are different or not to determine whether the content of the traffic information has been updated or not. In the example in FIG. 2, the determining unit 400 determines that the content of the traffic information has been updated from the traffic data set (N2) to the traffic data set (N3) and notifies the determination result to the transmission time estimating unit 380 and control unit 420.

The control unit 420 receives the notification that the content of the traffic information has been updated from the determining unit 400 and controls so as to permit the reception processing on data broadcast signals by the second tuner unit 300 for the period until the first data packet of the next traffic data set is received by the second tuner unit 300. The transmission time estimating unit 380 receives the notification that the content of the traffic information has been updated from the determining unit 400 and re-estimates the period from the determination that the traffic data set (N2') has been received to the determination that the separation packet of the next traffic data set (N3) has been received as a transmission time T3 for transmitting traffic data per transmission unit. The transmission time estimating unit 380 then outputs again the transmission time information describing the re-estimated transmission time T3 to the control unit 420.

In this way, when the power supply to the digital broadcast receiving apparatus 100 is started and every time the traffic information is updated, the transmission times T1, T2, and T3 for transmitting traffic data per transmission unit are estimated. After the estimation, if the content of the traffic information has not been updated when each traffic data set is received, the reception processing on traffic data is inhibited for a predetermined period of time based on the transmission time. This may prevent unnecessary reception processing in which the repeatedly transmitted data sets having the same content are received during a period when the content of the traffic data sets has not been updated even when the data broadcast signal does not contain information describing transmission intervals of the traffic data set. Moreover, if it is determined that the content of the traffic information has been updated, the reception processing on traffic data is permitted until the time when the next traffic data set is received. This further may prevent the inhibition of the reception processing on traffic data while the updated traffic data is being transmitted, which may securely prevent the dropping of the updated traffic data.

Figure 3:
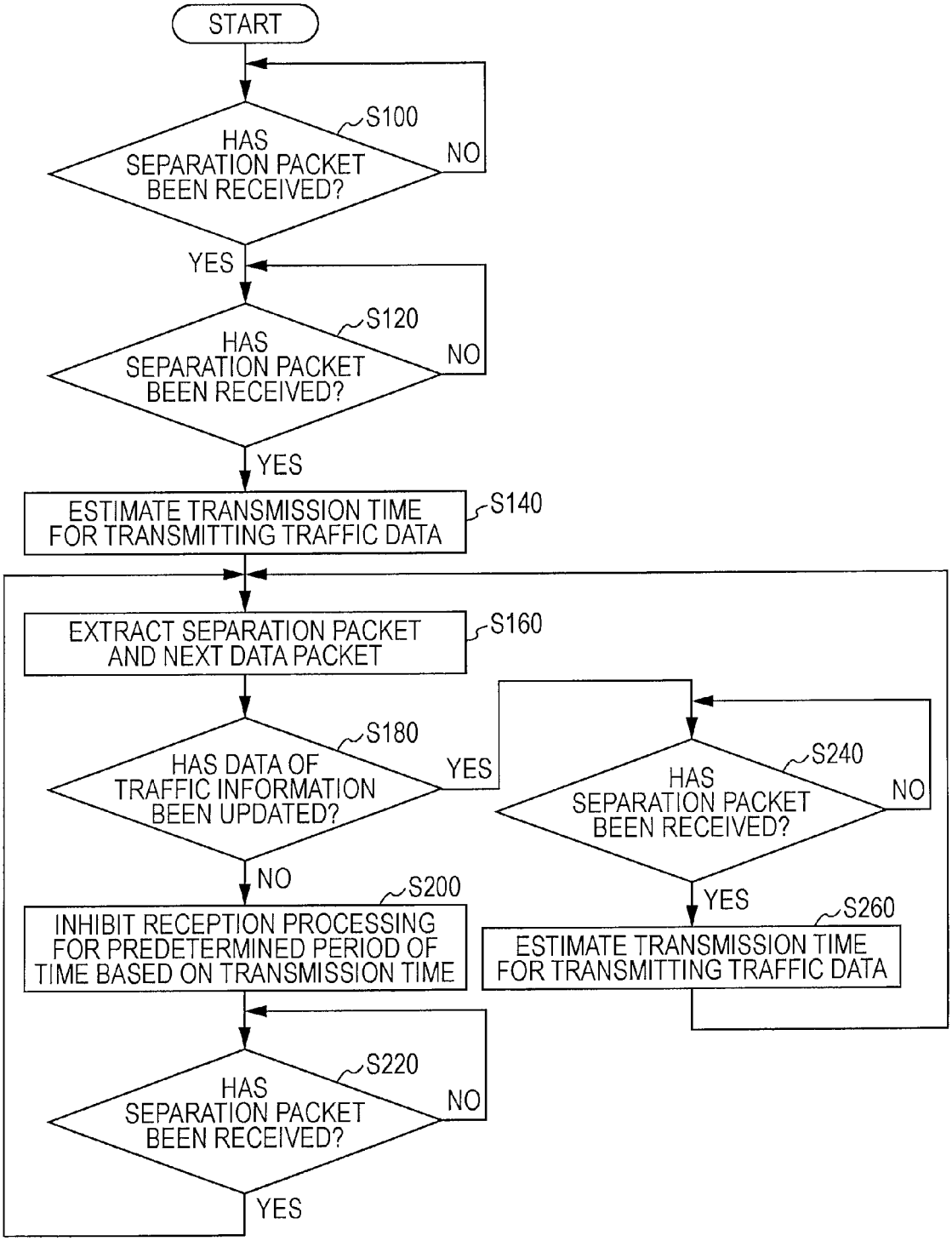
FIG. 3 is a flowchart illustrating a reception operation of the first embodiment.

Next, there will be described the reception operation on data broadcast signals by the digital broadcast receiving apparatus 100 of the first embodiment will be described. FIG. 3 is a flowchart illustrating a reception operation example on data broadcast signals by the digital broadcast receiving apparatus 100 of the first embodiment. The processing in step S100 in FIG. 3 is started by the start of the power supply to the digital broadcast receiving apparatus 100 in response to a user operation on an operating unit (not illustrated).

First, the transmission time estimating unit 380 checks whether the data packets output from the second tuner unit 300 to the data buffer 320 contain separation information or not to determine whether the separation packet identified by the separation information has been received by the second tuner unit 300 or not (step S100). If the transmission time estimating unit 380 determines that the separation packet has not been received by the second tuner unit 300 (NO in step S100), the processing moves to step S100.

On the other hand, if the transmission time estimating unit 380 determines that the separation packet has been received by the second tuner unit 300 (YES in step S100), the transmission time estimating unit 380 checks the data packets output from the second tuner unit 300 to the data buffer 320 contain separation information or not to determine whether the separation packet identified by the separation information has been received by the second tuner unit 300 or not (step S120).

If the transmission time estimating unit 380 determines that the separation packet has not been received by the second tuner unit 300 (NO in step S120), the processing moves to step S120. On the other hand, if the transmission time estimating unit 380 determines that the separation packet has been received by the second tuner unit 300 (YES in step S120), the transmission time estimating unit 380 estimates the period from the determination in step S100 that the separation packet has been received to the determination in step S120 that the separation packet has been received as the transmission time for transmitting traffic data per transmission unit (step S140). The transmission time estimating unit 380 outputs transmission time information describing the estimated transmission time to the control unit 420.

Next, the determining unit 400 fetches the separation packet received last by the second tuner unit 300 (the last data packet of one traffic data set) and the next data packet (the first data packet of the next traffic data set) from the data buffer 320 (step S160). Next, the determining unit 400 refers to the version information contained in the fetched data packets and determines whether the versions are different or not to determine whether the content of the traffic information has been updated or not (step S180).

If the determining unit 400 determines that the content of the traffic information has been updated (YES in step S180), the determining unit 400 notifies the determination result to the transmission time estimating unit 380 and control unit 420. The control unit 420 receives the notification that the content of the traffic information has been updated from the determining unit 400 and controls so as to permit the reception processing on data broadcast signals by the second tuner unit 300 for the period until the second tuner unit 300 receives the first data packet contained in the next traffic data set (until whether the traffic information has been updated or not is determined again).

The transmission time estimating unit 380 receives the notification that the content of the traffic information has been updated from the determining unit 400 and checks whether the data packets output from the second tuner unit 300 to the data buffer 320 contain separation information or not to determine whether the separation packet identified by the separation information has been received by the second tuner unit 300 or not (step S240).

If the transmission time estimating unit 380 determines that the separation packet has not been received by the second tuner unit 300 (NO in step S240), the processing moves to step S240. On the other hand, if the transmission time estimating unit 380 determines that the separation packet has been received by the second tuner unit 300 (YES in step S240), the transmission time estimating unit 380 re-estimates as the transmission time the period from the determination that one separation packet has been received immediately before the period when the control unit 420 permits the reception processing to the determination that the separation packet has been received in step S240 (step S260). The transmission time estimating unit 380 outputs the transmission time information describing the re-estimated transmission time to the control unit 420. After that, the processing moves to step S160.

Moving back to the determining processing in step S180, if the determining unit 400 determines that the content of the traffic information has not been updated (NO in step S180), the determining unit 400 notifies the determination result to the control unit 420. The control unit 420 receives the notification that the content of the traffic information has not been updated from the determining unit 400 and controls the second tuner unit 300 so as to hold reception for the predetermined period of time based on the transmission time described by the transmission time information output last from the transmission time estimating unit 380 (the period before the second tuner unit 300 receives the next separation packet) to inhibit the reception processing on data broadcast signals by the second tuner unit 300 (step S200). The control unit 420 notifies the fact to the determining unit 400 after a lapse of the predetermined period of time. Next, the transmission time estimating unit 380 checks whether the data packets output from the second tuner unit 300 to the data buffer 320 contain separation information or not to determine whether the separation packet identified by the separation information has been received by the second tuner unit 300 or not (step S220).

If the transmission time estimating unit 380 determines that the separation packet has not been received by the second tuner unit 300 (NO in step S220), the processing moves to step S220. On the other hand, if the transmission time estimating unit 380 determines that the separation packet has been received by the second tuner unit 300 (YES in step S220), the processing moves to step S160.

As described above in detail, according to the first embodiment, when the power supply to the digital broadcast receiving apparatus 100 is started, the transmission time for transmitting traffic data per transmission unit is estimated by using separation information contained in a data broadcast signal. After that, every time a traffic data set is received, whether the content of the traffic information has been updated or not is determined. If it is determined that the content has not been updated, reception processing on traffic data is inhibited for a predetermined period of time based on the estimated transmission time. On the other hand, if it is determined that the content has been updated, reception processing on traffic data is permitted.

According to the first embodiment having the aforementioned configuration, the transmission time for transmitting traffic data per transmission unit may be estimated on the basis of other data (separation information) even when GAP data is not available. After that, if the content of the traffic information is not updated every time the reception of traffic data is started, the reception processing on traffic data is inhibited for a predetermined period of time based on the transmission time. This may prevent unnecessary reception processing in which the repeatedly transmitted traffic data sets having the same content are received during a period when the content of traffic data has not been updated in reception of digital broadcast without information describing data transmission intervals. If the content of the traffic information has been updated, the reception processing on traffic data is permitted until the next traffic data set is received. This may prevent the inhibition of reception processing on traffic data while the updated traffic data is being transmitted and may securely prevent the dropping of the updated traffic data.

According to the first embodiment, if it is determined that the content of the traffic information has been updated, the transmission time is re-estimated by using separation information contained in data broadcast signals received by the second tuner unit 300 in a period when reception processing is permitted by the control unit 420. Thus, when the content of the traffic information has been updated, the reception processing during a period when the content of the traffic information has not been updated may be correctly inhibited by using the transmission time re-estimated in accordance with the amount of traffic data.

According to the first embodiment, if it is determined that the content of the traffic information has not been updated, the second tuner unit 300 is controlled so as to hold reception and inhibit the reception processing by the second tuner unit 300. However, the present invention is not limited thereto. For example, if it is determined that the content of the traffic information has not been updated, the power supply to the second tuner unit 300 may be controlled so as to stop and inhibit the reception processing by the second tuner unit 300. This may not only prevent unnecessary reception processing in which the repeatedly transmitted traffic data sets having the same content are received during a period when the content of traffic data has not been updated but also prevent unnecessary power consumption by the reception processing.

Figure 4:
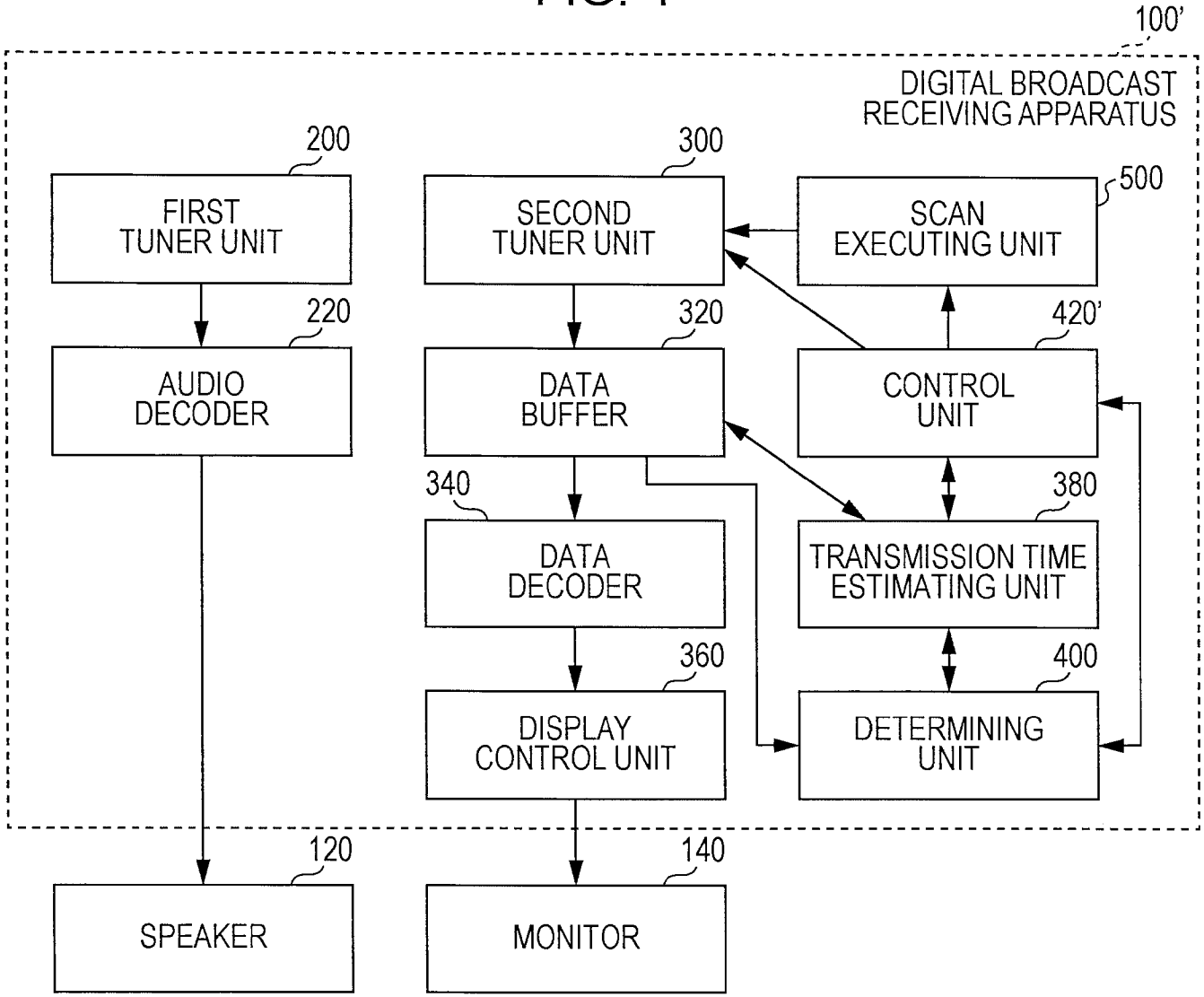
FIG. 4 is a block diagram of a digital broadcast receiving apparatus according to a second embodiment.
Figure 5:
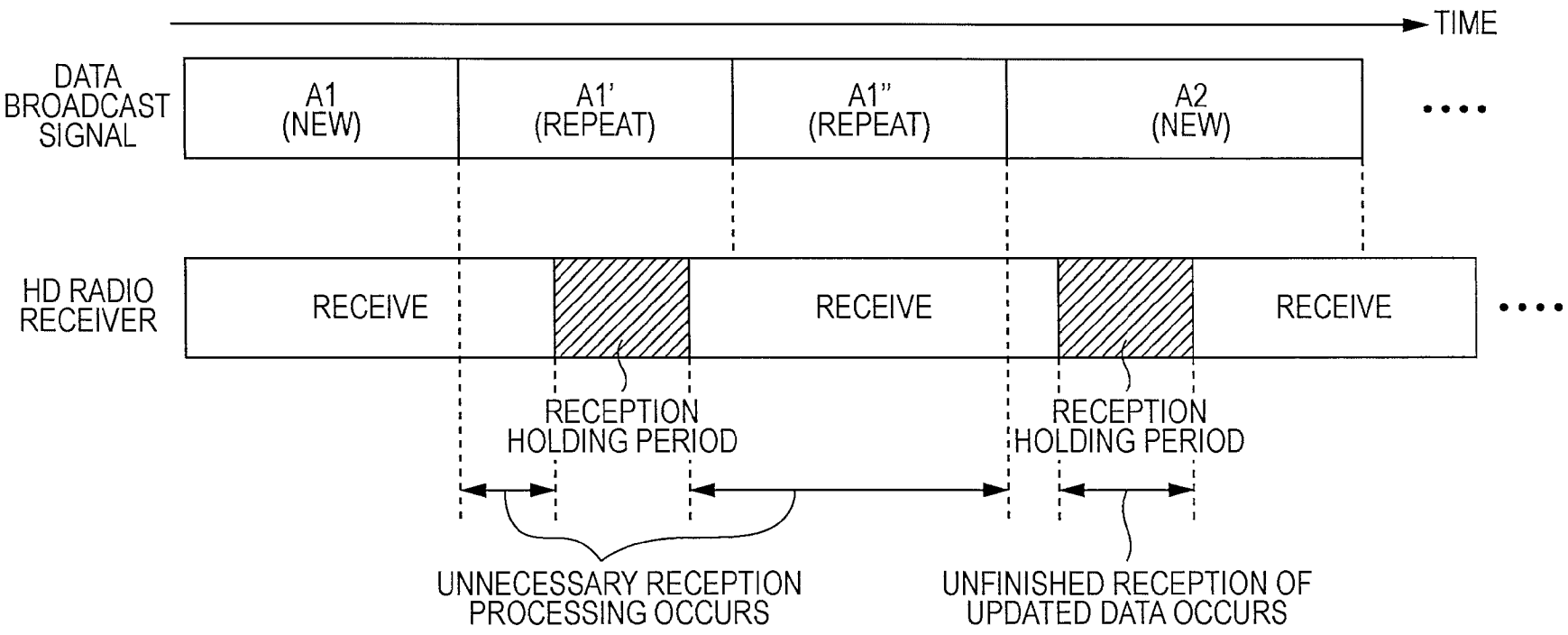
FIG. 5 illustrates a problem in data reception in the past.

A second embodiment of the present invention will be described below with reference to drawings. FIG. 4 is a block diagram illustrating an entire configuration example of a digital broadcast receiving apparatus 100' according to the second embodiment. According to this embodiment, the digital broadcast receiving apparatus 100' is mounted in a vehicle. As illustrated in FIG. 4, the digital broadcast receiving apparatus 100' includes a control unit 420' instead of the control unit 420 in FIG. 1. The digital broadcast receiving apparatus 100' further includes scan executing unit 500. Like numbers refer to like functions in FIGS. 1 and 4, and the repetitive description will be omitted.

The channels receivable by the digital broadcast receiving apparatus 100' may change in accordance with movement of the vehicle in which it is mounted. The scan executing unit 500 performs channel scan processing of detecting the presence of a receivable channel by controlling so as to change the reception frequency for each channel in the second tuner unit 300 under the control of the control unit 420'. Whether the changed channel is receivable or not may be determined in accordance with whether a BER (Bit Error Rate) value measured when the reception frequency of the channel is set is equal to or higher than a predetermined value or not, for example.

If the control unit 420' receives the notification that the content of the traffic information has not been updated from the determining unit 400, the control unit 420' controls so as to inhibit reception processing on data broadcast signals currently being received by the second tuner unit 300 and execute channel scan processing by the scan executing unit 500 for the predetermined period of time based on the transmission time described by the transmission time information output last from the transmission time estimating unit 380.

In the period excluding the predetermined period of time, the control unit 420' controls so as to permit the reception processing on data broadcast signals by the second tuner unit 300. In other words, if the control unit 420' receives the notification that the content of the traffic information has been updated from the determining unit 400, the control unit 420' controls so as to permit the reception processing on data broadcast signals by the second tuner unit 300 in the period until the first data packet of the next traffic data set is received by the second tuner unit 300.

As described above in detail, according to the second embodiment, if it is determined that the content of the traffic information has not been updated, the reception processing on data broadcast signals currently being received by the second tuner unit 300 is inhibited, and the channel scan processing of detecting the presence of a receivable channel is executed, for a predetermined period of time based on the transmission time estimated by the transmission time estimating unit 380. According to the second embodiment having the aforementioned configuration, during a period when the content of the traffic information has not been updated, the channel scan processing using the second tuner unit 300 is executed. This allows the second tuner unit 300 to be used for not only reception of traffic data but also the channel scan processing. Thus, even when the receivable channel in accordance with movement of the vehicle, the addition of a special tuner unit configured to execute the channel scan processing may prevent the increase in cost.

According to the first and second embodiments, the value resulting from the division of the total size of the packets received in the period from the reception of one separation packet to the reception of the next separation packet by the transmission rate of the data broadcast signal is estimated as the transmission time in the second tuner unit 300. However, the present invention is not limited thereto. For example, in the second tuner unit 300, a count operation by a timer (not illustrated) may be started from the time when one separation packet is received. On the basis of the timer count value until the time when the next separation packet is received, the transmission time may be estimated. This allows secure estimation of the transmission time for transmitting traffic data per transmission unit even when the data packets included in traffic data do not contain the size information on the data packets.

According to the first and second embodiments, the last data packet of a plurality of data packets included in traffic data is a separation packet. However, the present invention is not limited thereto. For example, the separation packet may be the first data packet of a plurality of data packets included in traffic data. In this case, the first data packet contains separation information describing that it is the first data packet. The transmission time estimating unit 380 may check whether the data packets received by the second tuner unit 300 include the separation information or not to identify the first data packet.

According to the first and second embodiments, data to be transmitted continuously by data broadcast signals is traffic data describing traffic information, for example. However, the present invention is not limited thereto. For example, the data to be transmitted continuously by data broadcast signals may be data describing weather information, up-to-the-minute sports news information, flight information or oil price information, for example.

Although preferred embodiments have been described in detail, the present invention is not limited to these specific embodiments. Rather, various modifications and changes can be made without departing from the scope of the present invention as described in the accompanying claims. Accordingly, all such modifications are intended to be included within the scope of this invention as defined in the following claims.

What is claimed is:

1. A digital broadcast receiving apparatus comprising:

a receiving unit having a first tuner and a second tuner;

the first tuner configured to receive a first digital broadcast signal having media content, the media content operatively output to a speaker;

the second tuner configured to receive a second digital broadcast signal in which predetermined data is transmitted repeatedly, the second tuner storing portions of data corresponding to the digital broadcast signal in a data buffer as data packets;

a transmission time estimating unit configured to estimate a transmission time for transmitting data per transmission unit, by analyzing separation information contained in the data packets stored in the data buffer, and by determining a size of the data received during a time period defined between successive data packets in the data buffer containing the separation information, the separation information describing a time for the transmission unit of the data corresponding to the predetermined data from the second tuner, wherein the transmission time estimating unit estimates the transmission time to be equal to a total size of packets received in a period defined by the reception of one separation packet to the reception of a next separation packet divided by a transmission rate of the digital broadcast signal;

a determining unit configured to determine whether content of the predetermined data has been updated for each data reception starting time after the transmission time has been estimated; and if the determining unit determines that the content has not been updated, the control unit is configured to inhibit reception processing by the second tuner for a predetermined period of time based on the estimated transmission time; and if the determining unit determines that the content has been updated, the control unit is configured to permit the reception processing by the second tuner.

2. The digital broadcast receiving apparatus according to claim 1, wherein, if the determining unit determines that the content has not been updated, the transmission time estimating unit re-estimates the transmission time by using the separation information during a period when reception processing is permitted.

3. The digital broadcast receiving apparatus according to claim 1, wherein the predetermined data includes a plurality of packets including a separation packet containing the separation information; and wherein the transmission time estimating unit estimates the transmission time as the time from the reception of one separation packet to the reception of a next separation packet.

4. The digital broadcast receiving apparatus according to claim 3, wherein the transmission time estimating unit estimates the transmission time based on a timer count value from the time when one separation packet is received to the time when a next separation packet is received.

5. The digital broadcast receiving apparatus according to claim 3, wherein a first packet of a plurality of packets included in the predetermined data contains version information describing a version of the predetermined information; and wherein the determining unit determines whether content of the predetermined information has been updated by checking the version information every time reception of the data by the receiving unit starts.

6. The digital broadcast receiving apparatus according to claim 3, wherein the separation packet is a last packet of a plurality of packets constituting the predetermined data.

7. The digital broadcast receiving apparatus according to claim 6, wherein the separation packet contains the separation information indicating that it is the last packet of the plurality of packets; and wherein the transmission time estimating unit identifies the last packet by checking whether packets received by the receiving unit contain the separation information.

8. The digital broadcast receiving apparatus according to claim 3, wherein the separation packet is a first packet of a plurality of packets included in the digital broadcast signal.

9. The digital broadcast receiving apparatus according to claim 8, wherein the separation packet contains the separation information indicating that it is the first packet of the plurality of packets; and wherein the transmission time estimating unit identifies the first packet by checking whether the packets received by the receiving unit contain the separation information.

10. The digital broadcast receiving apparatus according to claim 1, wherein if the determining unit determines that the content has not been updated, the control unit controls the receiving unit to inhibit the reception.

11. The digital broadcast receiving apparatus according to claim 1, wherein if the determining unit determines that the content has not been updated, the control unit turns off power to the receiving unit to inhibit the reception processing.

12. The digital broadcast receiving apparatus according to claim 1, wherein if the determining unit determines that the content has not been updated, the control unit inhibits reception processing on data being currently received by the receiving unit and causes channel scan processing to be executed to detect presence of a receivable channel.

13. A digital broadcast receiving method in a digital broadcast receiving apparatus, the apparatus including a receiving unit having a first tuner and a second tuner, the first tuner configured to receive a first digital broadcast signal having media content, the media content operatively output to a speaker, and the second tuner configured to receive a second digital broadcast signal in which predetermined data is transmitted repeatedly, the method comprising:

the second tuner storing portions of data corresponding to the second digital broadcast signal in a data buffer as data packets;

estimating, by a transmission time estimating unit, a transmission time for transmitting data per transmission unit by analyzing separation information contained in the data packets stored in the data buffer, and by determining a size of the data received during a time period defined between successive data packets in the data buffer containing the separation information, the separation information describing a time for the transmission unit of the data corresponding to the predetermined data from the second tuner, wherein the transmission time estimating unit estimates the transmission time to be equal to a total size of packets received in a period defined by the reception of one separation packet to the reception of a next separation packet divided by a transmission rate of the digital broadcast signal;

determining, by a determining unit, whether content of the predetermined data has been updated for each data reception starting time after the transmission time has been estimated;

if the content has not been updated, inhibiting reception processing by the second tuner for a predetermined period of time based on the transmission time; and if the content has been updated, permitting the reception processing by the second tuner.

* * * * *